US006341458B1

(12) United States Patent
Burt

(10) Patent No.: US 6,341,458 B1
(45) Date of Patent: Jan. 29, 2002

(54) EXTRUDED COMPOSITE CORNERS FOR BUILDING CONSTRUCTION

(75) Inventor: Kevin T. Burt, Columbus, OH (US)

(73) Assignee: Crane Products Ltd., Columbus, OH (US)

( * ) Notice: Subject to any disclaimer, the term of this patent is extended or adjusted under 35 U.S.C. 154(b) by 0 days.

(21) Appl. No.: 09/590,339

(22) Filed: Jun. 8, 2000

(51) Int. Cl.[7] ..... E04B 2/00; E04F 13/06

(52) U.S. Cl. ..... 52/287.1; 52/716.1; 52/716.8; D25/55; D25/119; D25/126; D25/136; D25/164

(58) Field of Search ..... 52/282.1, 282.4, 52/582.1, 731.7, 731.8, 287.1, 712, 716.8, 716.1, 288.1; 403/403, 382, 286, 293; D25/55, 61, 119, 126, 136, 164

(56) References Cited

U.S. PATENT DOCUMENTS 854,654 A * 5/1907 Krantz ..... 52/282.1
3,500,600 A * 3/1970 Bagley ..... 52/58
4,065,885 A * 1/1978 Blick ..... 52/143
4,189,885 A * 2/1980 Fritz ..... 52/287
4,196,553 A * 4/1980 Veach
4,210,274 A * 7/1980 Leonard
4,999,961 A * 3/1991 McNary
5,090,174 A * 2/1992 Fragale
5,664,376 A * 9/1997 Wilson et al.
5,706,620 A * 1/1998 De Zen ..... 52/220.2
5,746,333 A * 5/1998 Wuertemberger ..... 211/189
5,941,040 A * 8/1999 McAnallen ..... 52/586.1
5,960,598 A 10/1999 Tamlyn ..... 52/254
5,974,748 A * 11/1999 Sciuga et al.
6,103,791 A * 8/2000 Zehner ..... 524/13

* cited by examiner

*Primary Examiner*—Robert Canfield
(74) *Attorney, Agent, or Firm*—Standley & Gilcrest LLP

(57) ABSTRACT

Corner members, such as posts useful in construction of buildings and the like are described. The invention relates more specifically to recessed and protruding corner posts for building construction, the posts being formed from a polymer based cellulose reinforced composite. The posts provide sturdy, durable corner connections, for exterior building materials, that are easy to install, relatively inexpensive, and aesthetically pleasing.

10 Claims, 3 Drawing Sheets

EXTRUDED COMPOSITE CORNERS FOR BUILDING CONSTRUCTION

BACKGROUND AND SUMMARY OF THE INVENTION

The present invention relates generally to composite materials for buildings and the like. More specifically, this invention relates to thermoplastic polymer based composite corner members, such as trim strips or posts for building construction. The composite material may be comprised of cellulosic material, such as cementitious based cellulose reinforced material.

Corner posts are typically used at the vertical intersection of two side walls, either on the inside (i.e., recessed corners) or outside (i.e., protruding corners) of the intersection. Often, the exterior of the side walls is covered with planking, siding, or stucco. Newer materials such as fiber-containing concrete are also being used to cover building exteriors. Many of these materials leave openings or improperly sealed junctions at the intersection. These openings may allow moisture or insects to pass behind the exterior covering, thereby causing rot, crumbling, or other resultant damage. Exterior corners are also desirable to provide relative ease of installation of the wall intersections. It is therefore desirable to use a strong, durable corner or covering to create an appropriate seal at the exterior corner. It is also desirable that the corner or covering be aesthetically pleasing on the exterior of the building.

Similarly, recessed corners (on the exterior of buildings) are susceptible to many of the same problems as the protruding corners. Even with the addition of caulking material on the adjacent seams, protection can only be obtained for a short time. Eventually, the caulking material will dry and become brittle, allowing water and is insects to penetrate the wooden or other components.

It is therefore an object of the present invention to develop durable, water-tight corner posts for building construction that are easy to install, relatively inexpensive, and aesthetically pleasing.

The present invention comprises an extruded composite outside corner post for building construction. The outside corner post is preferably formed of a thermoplastic wood composite material. The corner post comprises perpendicular first and second elongated faces. These first and second faces are connected so as to form a right angle. The post has first and second elongated lips. The first elongated lip is located at the edge of the first elongated face, opposite the second elongated face. The first elongated lip extends into the region of the right angle, and is perpendicular to the first elongated face. The second elongated lip is located at the edge of the second elongated face opposite the first elongated face. The second elongated lip extends into the region of the right angle, and perpendicular to the second elongated face.

The post also comprises first and second angled extensions extending into the region of the right angle. The first angled extension is connected to the first face between the second face and the first lip. The first angled extension has a first extension portion that is parallel to but shorter than the second elongated face, and a first nailing flange that is parallel to the first elongated face and extends from the end of the first extension portion. The second angled extension is connected to the second face between the first face and the second lip. The second angled extension has a second extension portion parallel to but shorter than the first elongated face, and a second nailing flange that extends from the end of the second extension portion and is parallel to the second elongated face.

The first lip and first nailing flange of the first angled extension are preferably adapted to sufficiently contact the front and back faces, respectively, of an exterior building material when an end of the building material is placed in contact with the first extension portion of the first angled extension. The second lip and the second nailing flange of the second angled extension are preferably adapted to sufficiently contact the front and back faces, respectively, of an exterior building material when an end of the building material is placed in contact with the second extension portion of the second angled extension. The building material may be any material appropriate for exterior walls, such as extruded composite siding, vinyl siding, aluminum siding, fiber cement siding, and wood planking. The nailing flanges of the post may comprise openings adapted to allow passage of construction fastening devices. These fastening devices, such as nails or screws, may be used to rigidly affix the exterior building materials to the corner post.

The present invention also includes an extruded composite inside corner post for building construction, formed of a thermoplastic wood composite. The inside corner post comprises first and second elongated inner portions, the first and second inner portions connected so as to define a right angle. The post also has first and second nailing flanges. The first nailing flange extends from the end of the first elongated inner portion away from and parallel to the second inner portion. The second nailing flange extends from the end of the second elongated inner portion away from and parallel to the first inner portion. The post also comprises first and second elongated supports. The first elongated support extends from the first elongated inner portion, near the intersection of the first and second elongated inner portions and parallel to the first nailing flange. The second elongated support extends from the second elongated inner portion near the intersection of the first and second elongated inner portions, parallel to the first nailing flange.

The post also comprises first and second elongated lips. The first elongated lip extends from the end of the first elongated support parallel to and in the direction of the first elongated inner portion. The second elongated lip extends from the end of the second elongated support parallel to and in the direction of the second elongated inner portion.

The first lip and first nailing flange are preferably adapted to sufficiently contact the front and back faces, respectively, of a planar building material when an end of the building material is placed in contact with the first elongated inner portion. The second lip and second nailing flange are preferably adapted to sufficiently contact the front and back faces, respectively, of a planar building material when an end of the building material is placed in contact with the second elongated inner portion. The planar building material may be any appropriate exterior wall construction material, such as extruded composite planking, exterior building panels, and wood planking.

The inside corner post may additionally comprise openings in the first and second nailing flanges through which construction fastening devices may be passed. The post may also comprise openings in the first and second elongated inner portions through which construction fastening devices may be passed. These openings may facilitate the fastening of the post to a corner post of a building.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
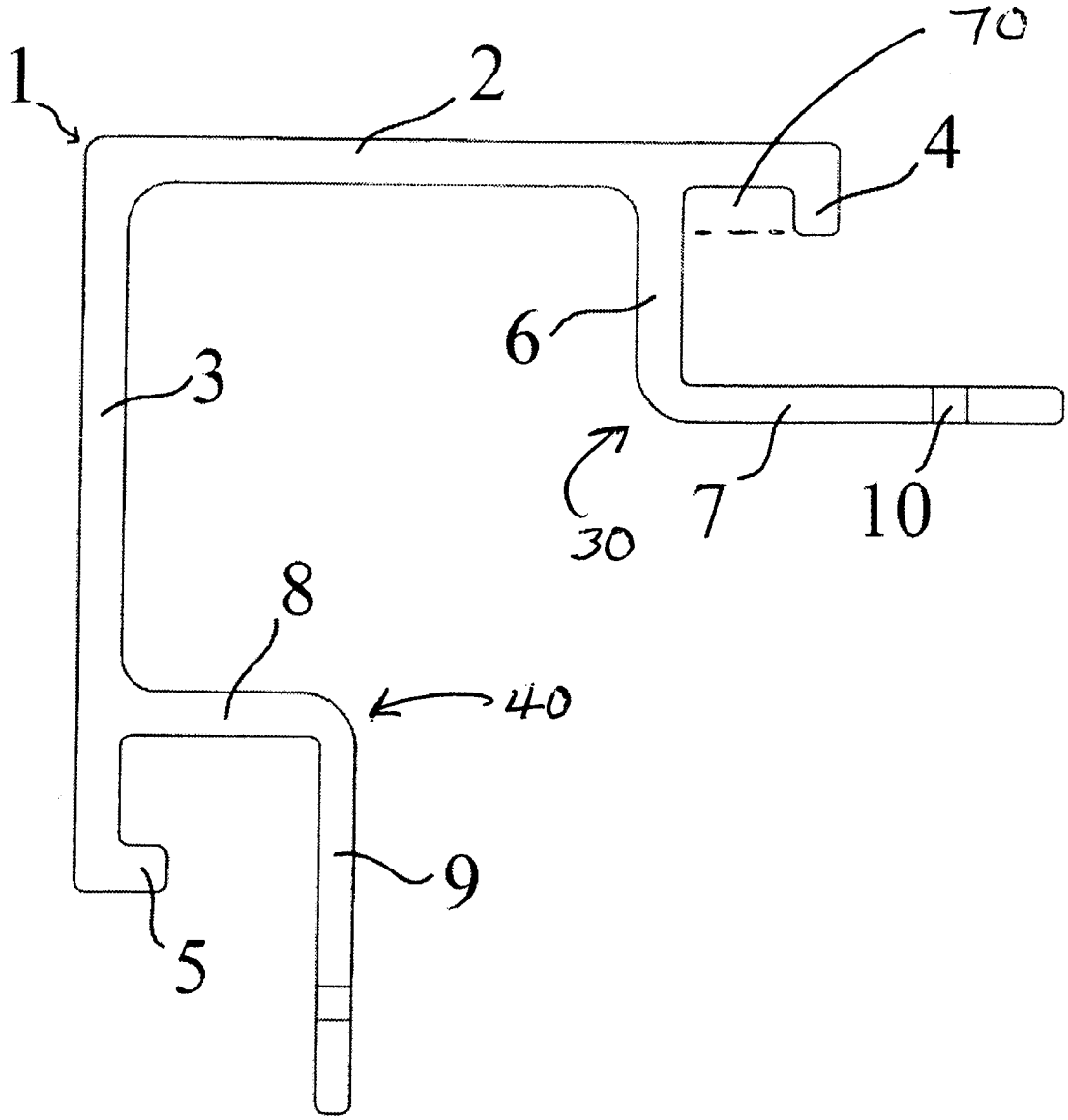
FIG. 1 is an end view of an exterior corner that may be used in accordance with the present invention.

The present invention is directed to interior and exterior corner posts for buildings and the like. FIG. 1 shows a preferred embodiment of an exterior corner post of the present invention. The exterior corner post 1 is shown from one end of the post. The post has a first elongated face 2 and a second elongated face 3. The faces are formed perpendicular to one another so as to form substantially a right angle. The elongated faces may be of any appropriate width, but in this selected embodiment are each approximately 4 ¼" wide. The posts may be of any appropriate length, such as posts of 6, 8, 10, 12, or 20 feet.

The post has a first elongated lip 4 and a second elongated lip 5. The first elongated lip 4 is located at the edge of the first elongated face 2, opposite the second elongated face 3. The first elongated lip extends into the region of the right angle and is perpendicular to the first elongated face. The distance from the inside of the first elongated lip to the outside of the first elongated face may be any appropriate distance, in this embodiment preferably about 0.525". The second elongated lip 5 is located at the edge of the second elongated face 3 opposite the first elongated face 2. The second elongated lip extends into the region of the right angle, preferably the same distance as the first elongated lip, and is perpendicular to the second elongated face 3.

The post also comprises first 30 and second 40 angled extensions extending into the region of the right angle. The first angled extension 30 is connected to the first elongated face between the second elongated face 3 and the first lip 4, preferably about 0.875" from the outside edge of the first lip to the outside edge of the extension 30 as it begins from the first face 2. The first angled extension 30 has a first extension portion 6 that is parallel to but shorter than the second elongated face 3, preferably about 1.575" in length from the outside edge of the first elongated face to the end of the first extension portion. The first angled extension 30 also has a first nailing flange 7 that is parallel to the first elongated face 2 and extends from the end of the first extension portion 6. The first nailing flange 7 may be of any appropriate length, preferably about 2.125".

The second angled extension 40 is connected to the second face 3 between the first face 2 and the second lip 5. The second angled extension has a second extension portion 8 parallel to but shorter than the first elongated face 2, again preferably about 1.575" in length from the outside edge of the second elongate face to the end of the first extension portion. The second angled extension preferably also has a second nailing flange 9 that extends from the end of the second extension portion 8 and is parallel to the second elongated face 3. The second nailing flange 9 may be of any appropriate length, preferably about 2.125".

The first lip 4 and the first nailing flange 7 of the first angled extension are preferably adapted to sufficiently contact the front and back faces, respectively, of an exterior building material when an end of the building material is placed in contact with the first portion 6 of the first angled extension. The spacing between the lip 4 and the first nailing flange 7 of the first angled extension may be any width appropriate for receiving a given building material, preferably about 0.850". Caulking or any other appropriate sealant may be placed in the pocket created by the lip and angled extension before inserting the building material, so as to create an enhanced water-tight seal. The second lip 5 and the second nailing hange 9 of the second angled extension are preferably similarly adapted.

The building material to be inserted into the outside corner may be any material appropriate for exterior walls, such as extruded composite siding, fiber cement siding, vinyl siding, aluminum siding, and wood planking. Such building material is installed in conventional manner onto the building, and ends of the building material, located at the corners, are received in the pocket created by the lips and the nailing flanges.

The post may additionally comprise openings 10 in the nailing flanges 7, 9, these openings adapted to allow passage of construction fastening devices. These fastening devices, such as nails or screws, may be used to rigidly affix the post to the building frame. The openings 10 may be of any size and shape appropriate for the fastening devices. The openings are preferably of an elongated or oval shape, preferably about 1.0" in length.

The exterior corner 1 may be molded in any appropriate color so as to match the appearance of a building exterior. The extruded corner may also have a pattern or texture formed on the outside faces so as to match the texture of pattern of a building material held in place by the corner.

Figure 2:
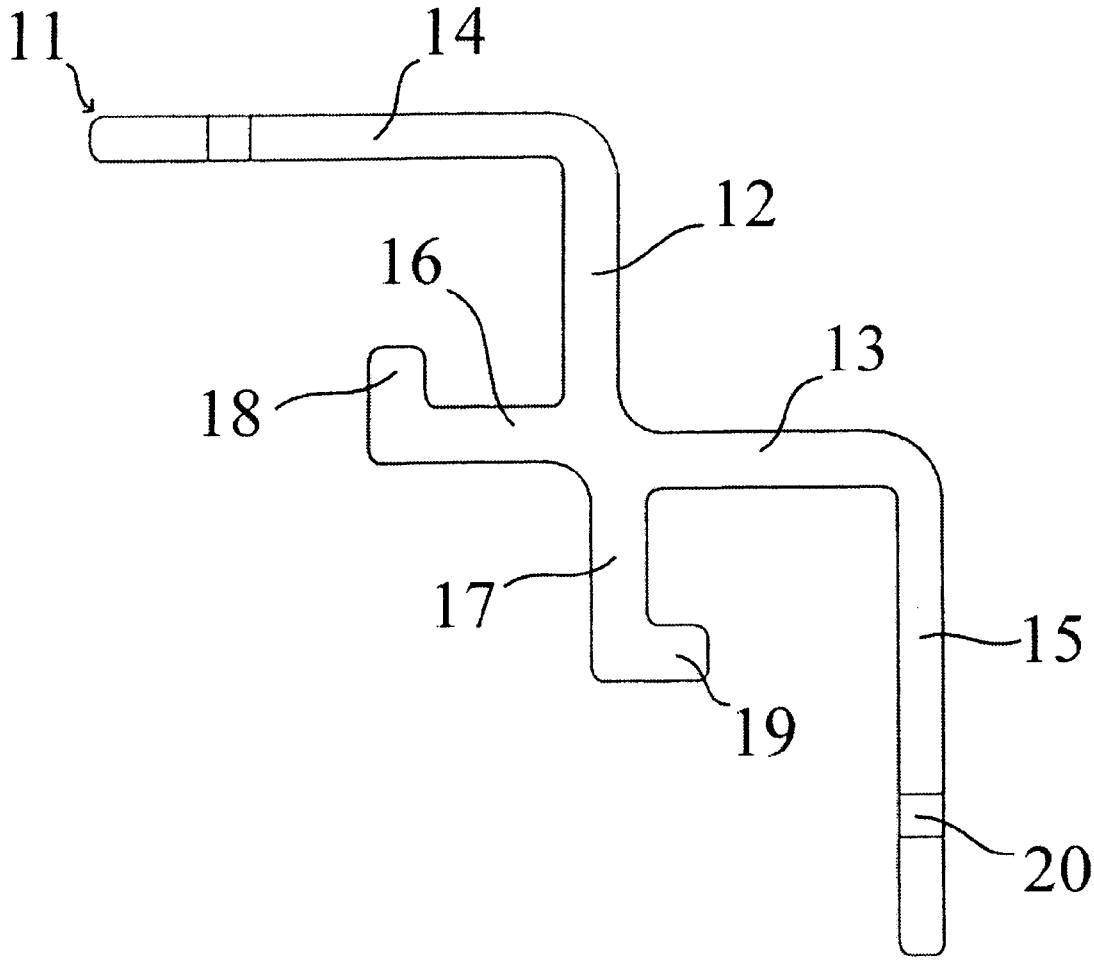
FIG. 2 is an end view of an interior corner that may be used in accordance with the present invention.

As shown in FIG. 2, the present invention also includes an extruded composite inside (recessed) corner post 11 for building construction, preferably formed of a vinyl based cellulose reinforced composite. The inside corner post 11 comprises a first elongated inner portion 12 and a second elongated inner portion 13, the first and second inner portions connected so as to define a right angle. The inner portions may be of any appropriate width, preferably equal widths. In a preferred embodiment, the width of each inner portion is approximately 1.3" to 1.6".

The post also has a first nailing flange 14 and second elongated nailing flange 15. The outer portions may be of any appropriate width, preferably of equal widths. In a preferred embodiment, the width of each outer portion is approximately 2.1" to 2.4". The first elongated flange 14 extends from the end of the first elongated inner portion 12 away from and parallel to the second inner portion 13. The second elongated flange 15 extends from the end of the second elongated inner portion 13 away from and parallel to the first inner portion 12.

The post also comprises a first elongated support 16 and a second elongated support 17. The elongated supports may be of any appropriate width, preferably of equal widths. In a preferred embodiment, the width of each support is approximately 0.9" to 1.1". The first elongated support 16 extends from the first elongated inner portion 12, near the intersection of the first and second elongated inner portions and parallel to the first elongated nailing flange 14. The second elongated support 17 extends from the second elongated inner portion 13 near the intersection of the first and second elongated inner portions, parallel to the second elongated nailing flange 15.

The post also comprises a first elongated lip 18 and a second elongated lip 19. The lips may be of any appropriate width, preferably of equal widths. In a preferred embodiment, the width of each lip is approximately 0.5" to 0.6". The first elongated lip 18 extends from the end of the first elongated support 16 parallel to and in the direction of the first elongated inner portion 12. The second elongated lip 19 extends from the end of the second elongated support 17 parallel to and in the direction of the second elongated inner portion 13.

Figure 3:
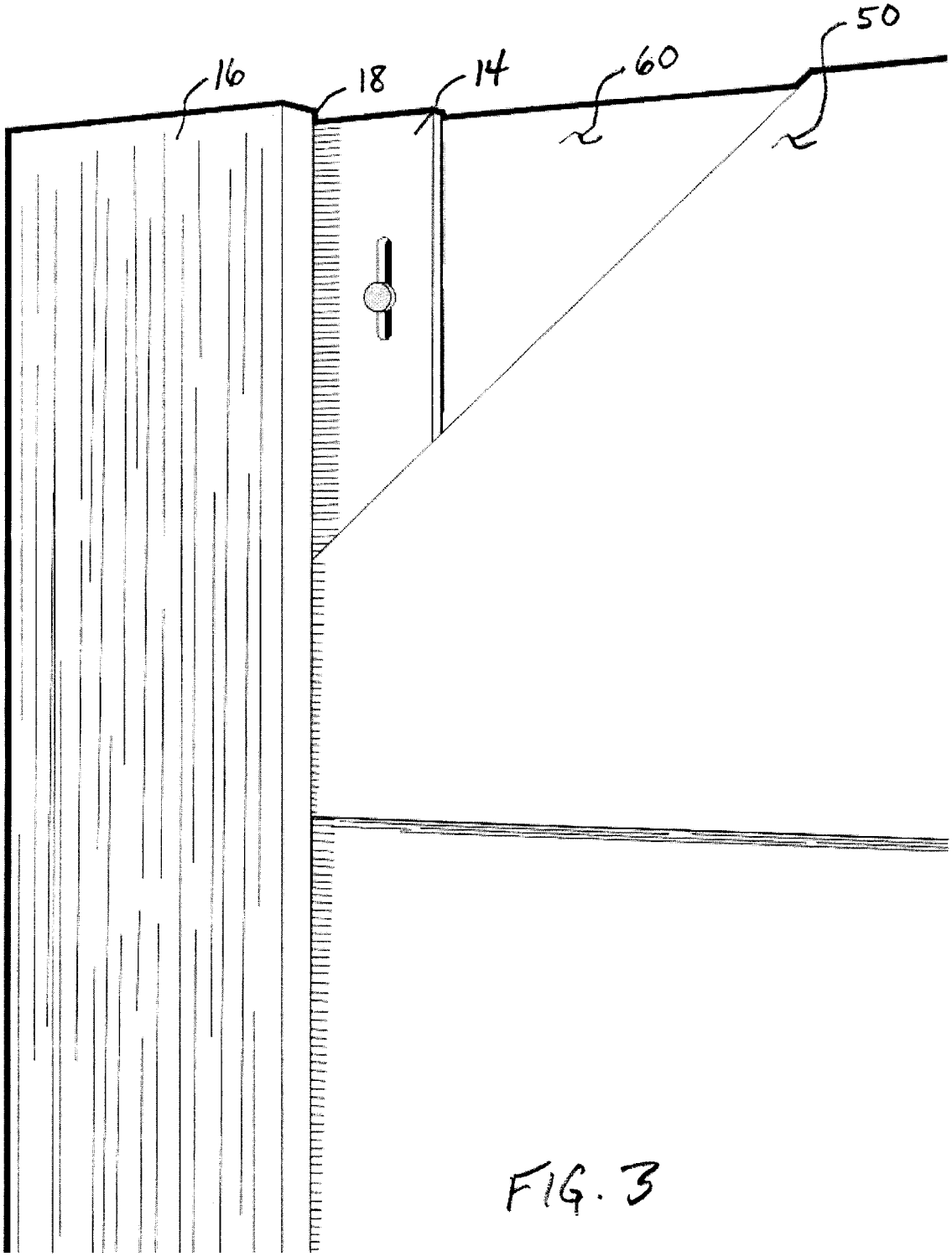
FIG. 3 is a perspective cutaway view of a corner member of the present invention installed on a building structure.

As shown in FIG. 3, the first lip 18 and first elongated nailing flange 14 define an area for receiving an exterior building material 50 when an end of the exterior building material is placed in the receiving area. The second lip 19 and second elongated outer 15 portion likewise define an area for receiving an exterior building material. The planar building material held in place by a corner may be any appropriate exterior wall construction material, such as extruded composite planking, fiber cement siding, interior building panels, and wood planking. Caulking or any other appropriate sealant may be placed in the pocket created by the lip and elongated extension before inserting the building material, so as to create an enhanced water-tight seal.

The recessed corner post 11 may additionally comprise openings 20 in the first and second elongated nailing flanges, 14 and 15 respectively, through which construction fastening devices may be passed to secure the corner 11 to the building frame. The openings 20 may be of any size and shape appropriate for the fastening devices. The openings are preferably of an elongated or oval shape, preferably about 1.0" in length.

The space 70 created between the exterior building material component (that resides between the lip and the nailing flange) and the elongated face of the corner post, serves as a weep path (or escape path) for moisture droplets and/or rain drops that may become otherwise trapped between the materials at the corner. It also allows for air circulation behind the exterior building material that may enhance the life and long lasting appearance characteristics of the invention and the exterior building material.

The extruded corner 11 may have a pattern or texture formed on the faces 16, 17 of the supports so as to match the texture or pattern of a building material being used.

The extruded composite used in forming the corners of the present invention may be any appropriate polymer based cellulose reinforced composite. In a preferred embodiment, the corners are formed of a cellulosic composite comprising: (a) at least one cellulosic material present in an amount in the range of from about 20% to about 60% by weight of the composite, and (b) at least one thermoplastic polymer material present in an amount in the range of from about 20% to about 70% by weight of the composite.

It is preferred that the cellulosic material(s) is/are present in an amount in the range of from about 30% to about 55% by weight of the composite. It is also preferred that the cellulosic material(s) be selected from wood saw dust, seed husks, ground rice hulls, newspaper, kenaf, coconut shells, bagasse, corn cobs, and peanut shells, and mixtures thereof.

It is preferred that the thermoplastic polymer material(s) be present in an amount in the range of from about 25% to about 60% by weight of the composite.

The composite thermoplastic compound may consist of rigid PVC dryblend compound, polyethylene, polypropylene or ABS combined with relatively high loadings of cellulose reinforcement.

An example PVC material for use in the present invention may include:

| Ingredient | Range (per 100 parts of resin) | Preferred Range (per 100 parts of resin) |
|---|---|---|
| PVC resin (I.V. range of 0.6–1.0) | 100 parts | 100 parts |
| Stabilizer | 2–8 phr | 2–4 phr |
| Lubricants | 4–10 phr | 4–6 phr |
| Process Aids | 1–4 phr | 1–2 phr |

Stabilizers may include tin, lead, barium and cadmium Common commercial lubricants known in the plastics processing industry, both internal and external, can be used. Examples of lubricants which can be used include calcium stearate, esters, paraffin wax, and amide wax.

Process aids such as acrylic modifiers for PVC aid fusion of the compound.

Additional components, for example foaming agents and compatibilizers, can be added if desired.

The cellulose material should be dried to between about 0.1%–3% in moisture content, preferably 0.1%–1.5% moisture by weight.

The dry blend may then be fed into an extruder e.g., a parallel, twin screw by Davis Standard.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An extruded composite outside corner post for building constuction, said outside corner post comprising:

(a) first and second elongated faces, said first and second faces forming a substantially right angle;

(b) first and second elongated lips along said post, said first elongated lip located at the edge of said first elongated face opposite said second elongated face, said first elongated lip extending into the region of said right angle and perpendicular to and integral with said first elongated face, said second elongated lip located at the edge of said second elongated face opposite said first elongated face, said second elongated lip extending into the region of said right angle and perpendicular to and integral with said second elongated face; and (c) first and second angled extensions extending into the region of said right angle, said first angled extension integral with and connected to said first face between said second face and said first lip, said first angled extension having a first extension portion parallel to but shorter than said second elongated face and a first nailing flange integral with and extending from the end of said first extension portion and parallel to and beyond said first elongated face, said second angled extension integral with and connected to said second face between said first face and said second lip, said second angled extension having a second extension portion parallel to but shorter than said first elongated face and a second nailing flange integral with and extending from the end of said second extension portion and parallel to and beyond said second elongated face.

2. An extruded composite outside corner post according to claim 1 wherein:

(a) said first lip and said first nailing flange of said first angled extension are adapted to sufficiently contact the front and back faces, respectively, of an exterior building material, an end of said exterior building material being placed in contact with said first extension portion of said first angled extension; and (b) said second lip and said second nailing flange of said second angled extension are adapted to sufficiently contact the front and back faces, respectively, of an exterior building material, an end of said exterior building material being placed in contact with said second extension portion of said second angled extension.

3. An extruded composite outside corner post according to claim 2 wherein said exterior building material is selected from the group consisting of extruded composite siding, vinyl siding, aluminum siding, fiber cement siding, and wood planking.

4. An extruded composite outside corner post according to claim 1 additionally comprising openings in said first and second angled extensions, said openings adapted to allow passage of construction fastening devices.

5. An extruded composite outside corner post according to claim 1 wherein said outside corner post is formed of a vinyl based cellulose reinforced composite.

6. An extruded composite inside corner post for building construction, said inside corner post comprising:

(a) first and second elongated inner portions, said first and second inner portions defining a substantially right angle;

(b) first and second nailing flanges, said first nailing flange extending from the end of said first elongated inner portion away from and parallel to said second inner portion, said second nailing flange extending from the end of said second elongated inner portion away from and parallel to said first inner portion; and (c) first and second elongated supports, said first elongated support extending from said first elongated inner portion near the intersection of said first and second elongated inner portions and parallel to and shorter than said first nailing flange, said second elongated support extending from said second elongated inner portion near the intersection of said first and second elongated inner portions and parallel to and shorter than said second nailing flange; and (d) first and second elongated lips, said first elongated lip extending from the end of said first elongated support parallel to and in the direction of said first elongated inner portion, said second elongated lip extending from the end of said second elongated support parallel to and in the direction of said second elongated inner portion.

7. An extruded composite inside corner post according to claim 6 wherein:

(a) said first lip and said first nailing flange are adapted to sufficiently contact the front and back faces, respectively, of a planar building material, an end of said planar building material being placed in contact with said first elongated inner portion; and (b) said second lip and said second nailing flange are adapted to sufficiently contact the front and back faces, respectively, of a planar building material, an end of said planar building material being placed in contact with said second elongated inner portion.

8. An extruded composite inside corner post according to claim 7 wherein said planar building material is selected from the group consisting of extruded composite planking, exterior interior building panels, and wood planking.

9. An extruded composite inside corner post according to claim 6 additionally comprising openings in said first and second nailing flanges through which construction fastening devices may be passed.

10. An extruded composite inside corner post according to claim 6 wherein said inside corner post is formed of a thermoplastic based cellulose reinforced composite.

* * * * *

UNITED STATES PATENT AND TRADEMARK OFFICE

CERTIFICATE OF CORRECTION

PATENT NO. : 6,341,458 B1
DATED : January 29, 2002
INVENTOR(S) : Burt

It is certified that error appears in the above-identified patent and that said Letters Patent is hereby corrected as shown below:

Column 1,
Line 54, after "the right angle, and" please insert -- is --.

Column 2,
Line 38, please delete "first" and replace it with -- second --.

Column 6,
Line 12, after the word "cadmium", please insert -- . --.

Signed and Sealed this

Ninth Day of July, 2002

*Attest:*

*Attesting Officer*

JAMES E. ROGAN
*Director of the United States Patent and Trademark Office*